United States Patent [19]

Tyler

[11] Patent Number: 4,464,976

[45] Date of Patent: Aug. 14, 1984

[54] TWO-STAGE PNEUMATIC SERVOMOTOR

[75] Inventor: Henry P. Tyler, South Bend, Ind.

[73] Assignee: The Bendix Corporation, Southfield, Mich.

[21] Appl. No.: 356,553

[22] Filed: Mar. 9, 1982

Related U.S. Application Data

[63] Continuation-in-part of Ser. No. 91,637, Nov. 5, 1979.

[51] Int. Cl.[3] ..... F15B 13/16

[52] U.S. Cl. ..... 91/365; 91/387; 91/461; 418/201

[58] Field of Search ..... 91/365, 387, 386, 461; 418/201

[56] References Cited

U.S. PATENT DOCUMENTS

| | | | |
|---|---|---|---|
| 1,520,242 | 12/1924 | Holmes | 418/201 |
| 3,095,906 | 7/1963 | Kolm, Jr. | 91/365 |
| 3,211,182 | 10/1965 | Gyurik et al. | 91/365 |
| 3,745,883 | 7/1973 | Ward et al. | 91/387 |

FOREIGN PATENT DOCUMENTS

| | | |
|---|---|---|
| 916973 | 1/1963 | United Kingdom . |
| 1099745 | 1/1968 | United Kingdom . |
| 1133077 | 11/1968 | United Kingdom . |
| 1140582 | 1/1969 | United Kingdom . |
| 1272859 | 5/1972 | United Kingdom . |
| 1410422 | 10/1975 | United Kingdom . |

*Primary Examiner*—Paul E. Maslousky

*Attorney, Agent, or Firm*—Leo H. McCormick, Jr.; Ken C. Decker

[57] ABSTRACT

A two-stage pneumatic servo valve assembly for controlling an output motor is disclosed. An input device, such as a torque motor, is coupled to the two-stage servo valve assembly. The first stage of the servo valve assembly includes a vane valve movable by the output of the torque motor to selectively provide a fluid path from an input source to one of the first-stage output channels. The first-stage pneumatic servo valve is coupled with a second stage servo valve. The second stage servo valve controls fluid flow from a pneumatic fluid source to an output motor. The second stage servo valve includes a slidable spool valve movable by fluid received from the first-stage servo valve. A feedback control from the second-stage servo valve to the first-stage servo valve is provided. A second feedback control is provided from the output of the output motor to the first stage servo valve.

7 Claims, 4 Drawing Figures

TWO-STAGE PNEUMATIC SERVOMOTOR

This is a continuation-in-part of application Ser. No. 91,637, filed Nov. 5, 1979, now abandoned.

BACKGROUND OF THE INVENTION

The present invention relates to a two-stage pneumatic servo valve assembly for controlling an output motor. The two-stage servo valve of the present invention has utility in a broad variety of applications, such as controlling vane positions on compressors, exhaust nozzles, and various aircraft function systems.

Two-stage servo valve systems have been used to provide fluid, pneumatic or hydraulic, to an output device such as a piston, wherein piston movement controls a load, such as a motor. Such systems provide for an input mechanism to control a first-stage valve which enables fluid under pressure to be provided to, and control, a second-stage valve. The second-stage valve controls fluid supply to the piston or other similar output device.

One such two-stage servo valve system is disclosed in U.S. Pat. No. 3,745,883. The system of this patent has applications in both pneumatic and hydraulic systems, and includes a second-stage spool valve having springs disposed in chambers at opposite ends of the spool valve to urge the spool valve into a null position. Fluid under pressure from the first stage is directed into the chambers that house the springs and is applied directly to the ends of the spool. The fluid pressure applied to the ends of the spool would appear to be a constant pressure. The second-stage valve controls a piston type of actuator.

U.S. Pat. No. 3,402,737 also discloses a pneumatic servo valve system using floating discs. Such system is both complex and costly to design and manufacture.

Two-stage hydraulic servo valves, such as shown in U.S. Pat. Nos. 3,555,970 and 3,949,645, are also known in the art, but have limited applicability to pneumatic systems. Due to the compressibility of pneumatic fluid, pneumatic systems are much more difficult to design for operation in a stable, responsive manner.

SUMMARY OF THE INVENTION

The invention herein provides for a two-stage pneumatic servo valve assembly for controlling a pneumatic powered output motor. The output motor is coupled to the two-stage servo valve which is in turn coupled to an input device for providing a suitable input signal. The first stage of the servo valve provides pneumatic fluid, under pressure, to the second stage of the servo valve, in response to the input signal. The second stage of the servo valve is coupled to the output motor and controls pneumatic fluid from a fluid source to the output motor. Feedback from the second stage to the first stage, as well as feedback from the output to the first stage is provided. The feedback from the second stage to the first stage serves to move the first stage valve toward its initial position following the movement of the second stage valve. The feedback from the output to the first stage serves to control the first stage valve in response to the motor output, wherein the first stage in turn controls the second stage to move the second stage servo valve back toward its initial position. The second-stage valve includes a pair of pistons disposed within chambers to receive pneumatic fluid from the first stage. Fluid from the first-stage valve acts upon the pistons to position the second stage valve into the desired position. The two-stage servo valve of the present invention provides for good response and stability, particularly when used in applications requiring variable supply pressures over broad ranges.

It is an object of the present invention to provide a new and unobvious two-stage pneumatic servo valve assembly having good response and stability over a broad range of supply pressures. Such response and stability results from a number of features of the present invention. For example, the use of two separate feedback mechanisms, one between the second stage and the first stage, and one between the output of the output motor and the first stage, ensures a stable and responsive system in the manner as described herein.

It is essential that the second-stage servo valve be stable, and free of oscillations. One technique to improve stability is to provide mechanical springs coupled to the second stage valve. However, the use of mechanical springs as the exclusive stabilizing means would ordinarily require such springs to be quite stiff, which makes it difficult to move the second stage valve at low supply pressures. In order to avoid this problem, it is desired to have the chamber volume, which receives pneumatic fluid from the first-stage valve to move a piston associated with the second-stage valve, at a minimum. This low volume chamber used in conjunction with a type of second-stage valve having small flow areas from the first stage, forms a stiff pneumatic spring which has a positive rate. This positive rate varies with supply pressure and offsets negative pneumatic rate that is developed by the second stage valve which also varies with supply pressure. In order to maintain the chamber volume at a minimum, the mechanical stabilizing springs must be isolated and separate from the chamber volume which receives fluid from the first stage. This is in contrast with prior art systems which place the stabilizing springs in the chamber which receives fluid under pressure from the first stage, necessarily requiring a rather large chamber volume to accommodate the springs. Thus, it is an object of the present invention to have a two-stage pneumatic servo valve wherein the second stage has a variable pneumatic spring to avoid use of stiff mechanical springs to provide stability to the second stage valve.

It is a further object of the present invention to provide a motor output, such as a pneumatic gear motor, instead of a piston output. A piston is weak as an output device because of the high volume of fluid at the end of the piston thus making the piston actuator of poor stiffness so that it cannot hold the output rigidly. On the other hand, a pneumatic motor output device, such as a gear motor as disclosed in the present invention, driving through a gear reduction means, such as a ball-screw actuator or a gear train, can have extremely high stiffness approaching that of a solid steel bar. The motor also has a rather low volume of gas under compression further giving good stiffness and fast response. Further, the motor assists in providing damping to the system which improves the stability of the overall system. Providing sufficient damping in pneumatic systems has generally been difficult to achieve.

Still further, it is an object of the present invention to provide damping tanks associated, through restrictors, with the second-stage valve chambers that receive fluid from the first stage. Such damping tanks improve the damping of the second-stage valve.

It is a further object of the present invention to provide a two-stage pneumatic servo valve operating at high forces to move the second-stage valve, thus ensuring the second-stage valve is movable even if obstructed by dirt or other foreign objects. When the two-stage pneumatic servo valve is used in an aircraft environment, no failure of the second-stage servo valve due to foreign object obstruction can be tolerated. In order to provide the high forces to move the second-stage valve, the pneumatic fluid from the first stage must act upon a large area. Thus, boost pistons are provided associated with the second-stage servo valve. The large areas of the pistons ensure high forces acting on the second-stage valve to overcome any obstruction. These high forces cannot be generated by applying pneumatic fluid directly to end areas of a second-stage slide valve since such end areas are not large enough. Since the shear area, or land area, for the slide valve is also related to its diameter, the diameter of the end areas of the valve must be limited, thus necessitating a separate boost piston coupled with the slide valve.

These and other objects of the present invention will become apparent when reference is made to the following detailed description read in conjunction with the accompanying drawings.

DETAILED DESCRIPTION OF THE INVENTION

Figure 1:
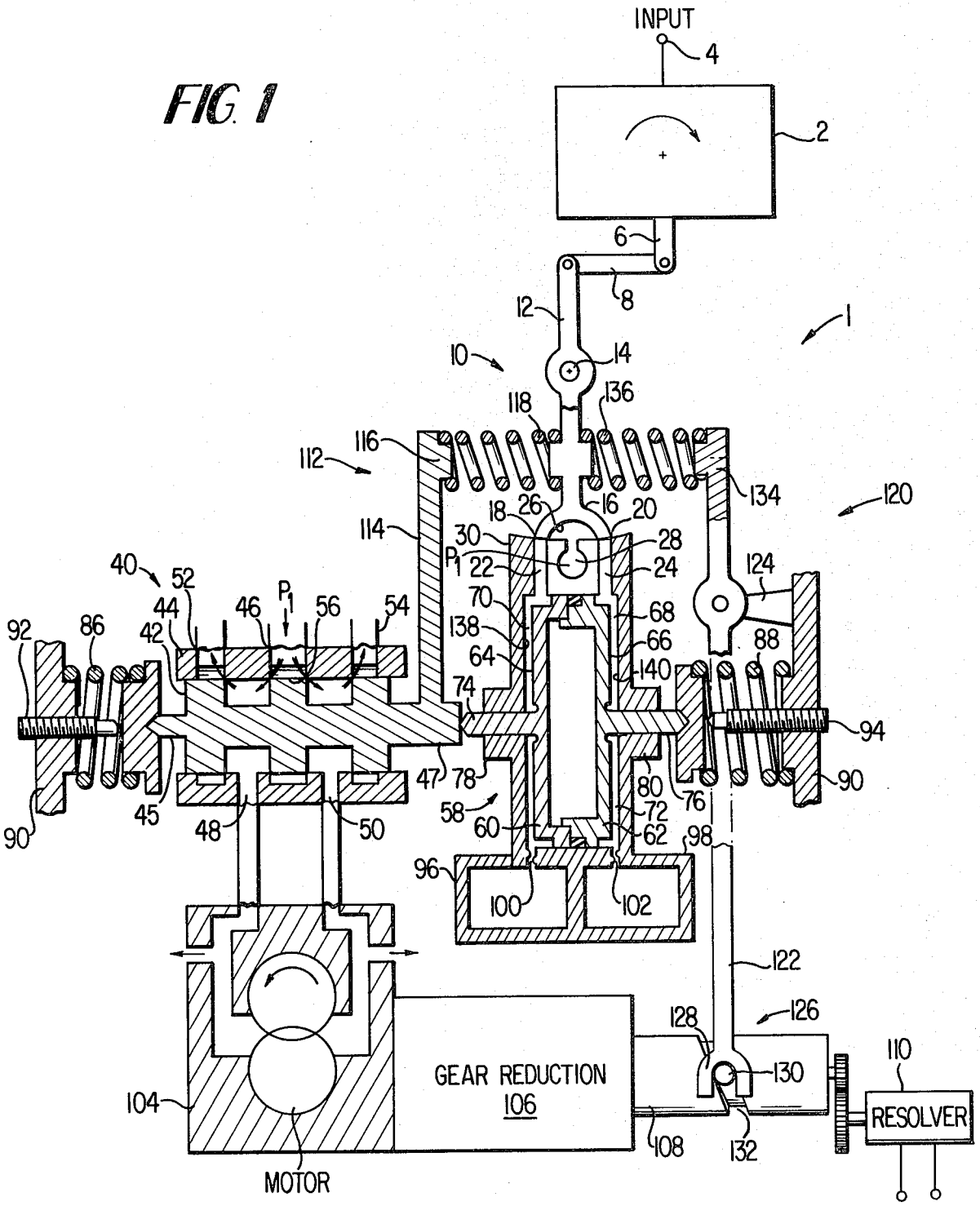
FIG. 1 is a schematic, partially in cross-section, of one embodiment of the present invention.

FIG. 1 is a schematic drawing of one embodiment of the servo valve 1 of the present invention. An input device, such as a torque motor 2 has an input terminal 4 for receiving an electrical input signal from a suitable electrical control apparatus, not shown. The electrical control apparatus may be a manually-controlled device, such as a potentiometer, or other device providing an analog output signal to the input terminal 4. Such electrical control apparatus may also include a general or special purpose digital computer to provide an analog output signal to the input terminal 4. The particular electrical control apparatus employed forms no part of the present invention. The torque motor 2 is of conventional design to receive an electrical analog input signal and to convert the electrical input signal to a mechanical output, such as a rotary output. Other types of devices that are capable of converting an electrical input signal to a mechanical output may be substituted for the torque motor. Indeed, the torque motor input device may be replaced with a mechanical, pneumatic, or hydraulic input device for converting a mechanical, pneumatic, or hydraulic input to a mechanical output. The input device must have a sufficient positive rate to offset any negative pneumatic rate that may exist in the first-stage servo valve assembly 10.

The torque motor 2 has an output arm 6 that is angularly displaceable in opposite directions depending upon the electrical input signal. The mechanical output displacement of the torque motor output arm 6 is relatively small and the angular displacement is normally around 0.010 inches.

The torque motor output arm 6 is connected through any suitable linkage 8 to the first-stage pneumatic servo valve assembly 10. The first stage 10 of the servo valve includes a vane valve 12 pivoted along its length at 14 for angular displacement in opposite directions by movement of the output arm 6 of the torque motor 2. One end 16 of the vane valve 12 is linked to the linkage 8. The opposite end 16 of the vane valve 12 is bifurcated to define two sealing areas 18, 20 to substantially seal off first 22 and second 24 output channels, or conduits. An arcuate face 26 is provided between the two sealing areas 18, 20 to receive pneumatic fluid, such as air, under pressure ($P_1$) from a first-stage input channel 28.

The vane valve 12 is illustrated in FIG. 1 in its initial, or first, position. The vane valve is angularly displaceable from its first position in opposite directions. In its first position, as illustrated, both the first and second output channels 22, 24 are substantially sealed off from the input channel 28. It is not necessary that the first and second output channels 22, 24 be completely sealed off. The sealing areas 18, 20 may be underlapped slightly to restrict flow and to permit a small flow to enter the channels 22, 24. However, this restricted flow is relatively negligible and is of insufficient magnitude to move the boost pistons 60, 62 in a manner to be described. The vane valve 12 is movable to a second position (e.g., a clockwise position) wherein the input channel 28 is in communication with the first output channel 22. Similarly, the vane valve 12 is movable to a third position (e.g., a counterclockwise position) wherein the input channel 28 is in communication with the second output channel 24. The second and third positions are defined herein as variable depending upon the degree of angular displacement of the vane valve 12. That is, the second position is defined herein as any position of the vane valve 12 such that sufficient fluid communication between the input channel 28 and the first output channel 22 only exists. The third position is defined similarly.

The first-stage input channel 28 receives pneumatic fluid, such as air, from a pneumatic fluid source, not shown. The fluid source, is variable and generally has an input pressure $P_1$ from approximately 60 to 600 psig. The input 28 and output channels 22, 24 are defined in a housing 30 that forms part of the second-stage valve, to be described further below. The first and second first-stage output channels 22, 24 communicate with chambers 70, 72 that house boost pistons 60, 62 of the second-stage valve 40 in a manner to be described below.

When the vane-valve 12 is moved to its second position, it should be appreciated that pneumatic fluid from the input channel 28 is coupled to the first output channel 22 only, and no input fluid is coupled to the second output channel 24. During this second position, the second output channel 24 couples the chamber 72 to an exhaust opening, not shown, preferably at atmospheric pressure. The exhaust opening may be part of an overall servo valve housing, not shown. When the vane valve 12 is moved to its third position, the function is similar, but opposite.

Although a pivotable vane valve 12 is shown, it should be appreciated that other forms of valves may be submitted therefor, so long as the function remains the same at that discussed above.

The second-stage 40 of the servo valve assembly 1 includes a slide valve such as a cylindrical spool valve 42 disposed in a housing 44. The spool valve 42 has extensions 45, 47 extending along the major axis of the spool valve 42. The housing 44 has a second-stage input channel 46 which is coupled to the variable pneumatic pressure source, not shown. The housing 44 further comprises first 48 and second 50 second-stage output channels communicating with a gear motor 104, to be described further below. A pair of exhaust conduits 52, 54 are also provided in the housing 44.

The spool valve 42, as shown in FIG. 1, is in its initial, or first, position. In this first position, pneumatic fluid under pressure ($P_1$) from the second-stage input channel 46 is substantially sealed, or blocked by the central land 56 of the spool valve 42 and thus substantially no fluid communication from the input channel 46 to either of the first or second output channels 48, 50 is possible. It is not necessary that the first and second output channels 48, 50 be completely sealed off. The central land 56 of the spool valve 42 may be underlapped slightly to restrict flow and to permit a small flow to enter the channels 48, 50. This restricted flow is relatively negligible and is of insufficient magnitude to activate the motor 104. However, by permitting a small flow to the output channels 48, 50, the channel pressures remain built-up, thus permitting better dynamic response and accuracy for the output motor 104. The spool valve 42 is slidable in opposite directions to selectively open one of the first and second output channels 48, 50. That is, when the spool valve 42 is shifted toward the right of FIG. 1 (its second position), the input channel 46 is in communication only with the first second-stage output channel 48. Likewise, the second-stage output channel 50 is in communication with the exhaust channel 54. When the spool valve 42 is shifted to the left side of FIG. 1 (its third position), the input channel 46 is in communication only with the second second-stage output channel 50. In this third position, the first second-stage output channel 48 communicates with the exhaust channel 52.

As with the first-stage vane valve 12, the second and third positions of the spool valve 42 are variable depending upon the amount of linear displacement of the spool valve 42. Moreover, the second-stage spool valve 42 may be substituted with other forms of valves having the same function. For example, the second-stage spool valve 42 may be substituted with a vane valve similar to the vane valve 12.

The spool valve 42 is coupled to a boost piston assembly 58. The boost piston assembly 58 comprises a housing 30 that defines the first and second first-stage output channels 22, 24. Boost pistons 60, 62 are positioned in back-to-back relationship, connected with each other, having piston faces 64, 66 substantially parallel to each other facing opposite directions. The boost pistons are positioned in a substantially cylindrical chamber 68 in the housing 30. The pistons 60, 62 and the housing 30 define a first chamber 70 and a second chamber 72 for receiving pneumatic fluid from the first and second first-stage output channels 22, 24, respectively. The first output channel 22 of the first stage communicates with piston face 64 of the boost piston 60, whereas the second output channel 24 of the first stage communicates with piston face 66 of the boost piston 62.

Each boost piston face 64, 66 has rods 74, 76 extending perpendicular thereto acting as journals for support within bearings 78, 80 in the housing 30. Rod 74 abuts the spool valve extension 47 and may be physically connected thereto. Rod 76 engages an abutment 84. A similar abutment 82 is provided to engage with extension 45 of the spool valve 42. Abutments 82, 84 are spring biased by stabilizing springs 86, 88 which engage fixed reference points on a housing 90. These springs 86, 88 bias the second-stage spool valve 42 in opposite directions and assist in providing a positive rate to the spool valve in a manner to be described. The spring force of the springs 86, 88 is not sufficiently great so as to re-center the spool valve 42 against the holding forces from the boost pistons 60, 62, i.e., move the spool valve 42 to its first position, after the spool valve is moved to one of its second and third positions, as will be described further below. Adjacent each abutment 82, 84 are adjustable stops 92, 94 to limit spool valve movement.

The first and second chambers 70, 72 housing the boost pistons 60, 62 are respectively coupled to a pair of damping tanks 96, 98 which assist in damping the movement of the second-stage spool valve 42. Each tank 96, 98 is in separate fluid communication with first and second chambers 70, 72. Restrictor openings 100, 102 are provided between each chamber 70, 72 and a respective damping tank 96, 98.

The first and second second-stage output channels 48, 50 are coupled to a motor such as a pneumatic-powered gear motor 104. Preferably the gear motor 104 has helical motor gears which receive the pneumatic fluid under pressure from one of the first and second output channels 48, 50 to drive the motor in opposite directions. The pneumatic-powered output motor 104 is conventional. The motor 104 is coupled to a gear reduction assembly 106, such as a conventional planocentric gear train having a high ratio, such as a 70 to 1 ratio. The gear reduction assembly 106 is part of a feedback system to be described below. The output of the motor 104, not shown, serves to drive a suitable output device. The gear reduction assembly 106 has a rotatable output shaft 108. The output shaft 108 of the gear reduction assembly 106 is connected to a conventional resolver 110 which provides an electrical feedback output signal dependent upon the rotary output shaft 108 position. The feedback signal may be electrically coupled to the torque motor 2 to provide a feedback adjustment to the first-stage vane valve 12, in a manner to be described. The gear reduction output shaft 108 is also coupled to a mechanical feedback assembly, as will be described below.

Two mechanical feedback arangements are provided to assure a responsive and accurate two stage servo valve. The first feedback arrangement 112 is from the second-stage servo valve 40 to the first-stage servo valve 10. Feedback arrangement 112 comprises a feedback arm 114 coupled to the second-stage spool valve extension 47. The arm 114 extends substantially perpendicular to the major axis of the spool valve 42 and has an opposite end 116 adjacent to the vane valve 12. A first feedback spring 118 is coupled between the vane valve 12 and the end 116 of the feedback arm 114.

The second feedback arrangement 120 provides feedback from the output shaft 108 to the first-stage vane valve 10. The second-feedback arrangement 120 comprises a lever 122 that is pivotally connected between the ends of the lever 122 to a fixed reference 124, which may be associated with a housing 90. One end 126 of the lever 122 forms a bifurcated fork 128 connected to a ball 130 of a ball-screw arrangement 132 of the output shaft 108 of the gear reduction assembly 106. Rotation of the output shaft 108 angularly displaces the feedback lever 122. The opposite end 134 of the lever 122 is adjacent the first-stage vane valve 12 in the same plane as the end 116 of the feedback arm 114, and is coupled to the vane valve 12 by a second feedback spring 136. In the position shown in FIG. 1, the feedback springs 118, 136 serve to maintain the vane valve 12 in its first position.

Operation of the FIG. 1 embodiment will now be described. Upon receipt of an electrical input signal at the input terminal 4, the torque motor 2 provides a mechanical movement to the torque motor output arm 6 that serves to angularly displace the vane valve 12 in a clockwise or counterclockwise direction. Assume, for purposes of discussion, the vane valve 12 is displaced in a clockwise direction. Rotation of the vane valve 12 in a clockwise direction (i.e., its second position) serves to provide a fluid communication path from the first-stage input channel 28 to the first first-stage output channel 22. The first-stage output channel 22 communicates with the chamber 70, and thus pneumatic fluid under pressure is provided to piston face 64 of the boost piston 60, which serves to displace the piston 60 toward the right as viewed in FIG. 1. The spool valve 42, as biased by the stabilizing spring 86 will likewise shift to the right (its second position) thus opening a fluid communication path from the second-stage input channel 46 to the first second-stage output channel 48. Pneumatic fluid under pressure is thus provided to the motor 104 to drive the motor in a predetermined direction. As the spool valve 42 moves to the right of FIG. 1, the feedback arm 114 likewise moves to the right and compresses first feedback spring 118. This compression of the first feedback spring 118 serves to bias the vane valve 12 back toward its initial, or first, position. The vane valve 12 may be fully returned to its first position, or may be slightly off-center, depending upon the force of the feedback spring. In any event, the fluid pressure in chamber 70 remains sufficiently high to provide a holding force on the boost piston face 64. The second-stage spool valve 42 remains in its second position and is not moved by the stabilizing spring 88 to return to its first position since the spring force of the stabilizing spring 88 is not sufficiently great to overcome the holding boost piston force. Thus, the spool valve 42 remains in its second position, whereby communication from the second-stage input channel 46 to the first second-stage output channel 48 remains coupled. The motor 104 is thus operated and an output, through the gear reduction assembly 106 rotates the output shaft 108 which angularly displaces the feedback lever 122 in a clockwise direction. Movement of the feedback lever 122 in a clockwise direction results in a lengthening of the second feedback spring 136, reducing bias on the vane valve 12 which results in a movement of the vane valve 12 in a counterclockwise direction (i.e., from its first to its third position). Movement of the vane valve 12 in a counterclockwise direction serves to provide input pressure from the first stage input channel 28 to the second first-stage output channel 24 thus moving boost piston 62 towards the left side of FIG. 1. Movement of the boost piston 62 toward the left serves to re-center the spool valve 42 back to its first position. Movement of the spool valve 42 back to its first position likewise moves the first feedback arm 114 toward the left of FIG. 1, thus easing the force on the vane valve 12 to center the vane valve 12 to its first position. This system is now ready for another operation.

For proper operation of the present invention, the volume of the first and second chambers 70, 72 must be at a minimum. As the second-stage spool valve 42 opens, supply pressure from the second-stage input channel 46 tends to have a negative rate effect on the spool valve 42, i.e., tending to cause the spool valve 42 to open more with increased supply pressure. This negative rate effect cannot be offset solely by the stabilizing springs 86, 88 since they are designed not to have too great a spring force, for the reasons discussed below. By providing the volumes of the chambers 70, 72 at a minimum, the chambers 70, 72 act as stiff pneumatic springs whose rate varies with supply pressure. This stiff pneumatic spring effect has a positive rate which tends to offset the negative rate of the second-stage spool valve 42. In order to assure that the volume of the chambers 70, 72 are at a minimum, it is preferred that the maximum distance between the piston faces 64, 66 and opposite walls 138, 140 of its respective chambers 70, 72 are substantially equal to, or just greater than, the maximum stroke of the boost pistons 60, 62.

The stabilizing springs 86, 88 are of insufficient spring force to offset the negative pneumatic rate of the spool valve 42. If the stabilizing springs 86, 88 were too stiff, it would be difficult to move the spool valve 42 at low supply pressures.

it is further required that the piston face areas 64, 66 be relatively large in order to provide a high output force, at low supply pressures, to move the spool valve 42, particularly if the spool valve becomes obstructed by some foreign object. Although the precise area required will vary depending upon the supply pressure ranges, it has been found that effective results occur when the areas 64, 66 are approximately 4–6 times the end area of the spool valve.

Figures 2, 3, 4:
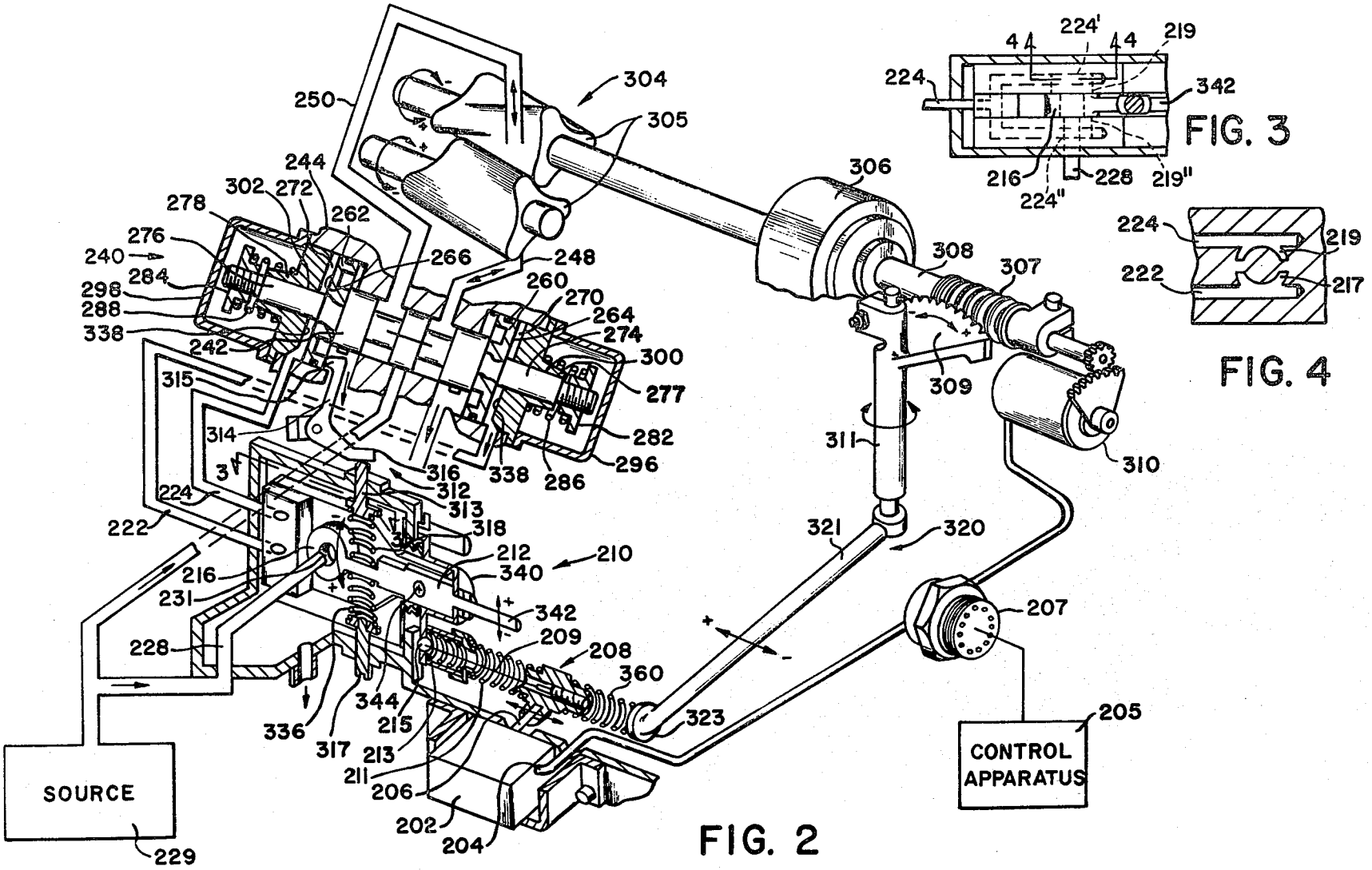
FIG. 2 is a schematic perspective of an alternate embodiment of the present invention.
FIG. 3 is a top view of the fluid distribution system for the vane valve taken along line 3—3 in FIG. 2.
FIG. 4 is a sectional view taken along line 4—4 of FIG. 3.

Another two stage servo valve embodiment 201 is shown in FIG. 2. This embodiment is similar in operation to the FIG. 1 embodiment, however includes certain structural differences as will be described hereinbelow. The numbering of the FIG. 2 embodiment parallels the numbering of the FIG. 1 embodiment as much as possible, but by an additive factor or "200". Thus torque motor 2 of FIG. 1 is numbered "202" in FIG. 2.

The torque motor 202 is similar to the torque motor 2 of the FIG. 1 embodiment. Electrical input signals are provided from an electrical control apparatus 205 through a terminal plug 207 to the input terminal 204 of the torque motor 202. As in the FIG. 1 embodiment, other input devices, including mechanical, pneumatic, or hydraulic input devices may be used instead of the torque motor 202. The torque motor 202 has an angular mechanical output through output shaft 206 which is coupled to linkage 208 connected to a first-stage vane valve 212 of the type fully disclosed in U.S. Pat. application Ser. No. 126,159 filed Feb. 29, 1980 and now U.S. Pat. No. 4,333,390. The linkage 208 comprises a taut wire 209 connected with a ball 215 at one end and biased by a spring 211 to maintain the wire 209 taut. The linkage 208 is functionally equivalent to a fixed rod and is linearly movable by shaft 206. The ball 215 is seated in a seat 213 which is fixed to a projection of a cup-shaped member 340. The cup-shaped member 340 is fixed to rod 342 of the first-stage vane valve 212. Linear movement of the seat 213, caused by a pulling or pushing force applied to wire 209, results in angular displacement of the rod 342 to move the vane valve 212 about its pivot point 344. Any suitable mechanical linkage may be employed to obtain the desired movement.

The vane valve 212 is pivoted for angular displacement in opposite directions, from a first to second and third positions, similar to the vane valve 12 of FIG. 1. One end 216 of the vane valve 212 is an annular ring which, in its first position as shown, substantially closes, or seals, two output channel openings 217, 219 that are arcuate in shape as shown in FIG. 4. First and second first-stage output channels 222, 224 extend from the output openings 217, 219 to the second-stage valve 240. The first stage input channel 228 extends from a pneumatic fluid source 229 to the center 231 of the annular ring of the vane valve 212. As with the fluid source for the two stage servo valve shown in FIG. 1, the fluid pressure from source 229 is variable and operates in the range of from 60 to 600 psig. When the vane valve 212 is displaced in opposite directions, i.e., its second and third positions, the input channel 228 is in communication with one of the first and second first-stage output channels 222, 224 to allow fluid to flow through the center 231 of the annular ring 216 into the corresponding opening 219, 217 for distribution to the second stage valve 240.

As best shown by the top view of the vane valve 212 in FIG. 3, the output channels 224 and 222 each divide into two legs, namely legs 224' and 224" and legs 222' and 222", respectively (the latter legs not being shown). On movement of annular ring 216, fluid equally flows from center 231 through openings 219 and 219' to legs 224' and 224" or through openings 217 and 217' to legs 222' and 222" to create a balanced force condition on said annular ring 216.

The first and second first-stage output channels 222, 224 extend to chambers 270, 272 for communication with first and second boost pistons 260, 262. In this FIG. 2 embodiment, the boost pistons 260, 262 are secured to opposite ends of the spool valve 247, parallel to each other, having piston faces 264, 266 facing in opposite directions. The chamber volumes 270, 272 are defined by the boost piston end faces 264, 266, housing 244 and walls 338. As in the FIG. 1 embodiment, the volume of the chambers 270, 272 is small such that the distance between the piston faces 264, 266 and the opposite walls 338 of the chambers 270, 272 are substantially equal to, or just greater than, the maximum displacement of the boost pistons. Similarly, the end face areas 264, 266 of the pistons are relatively large, substantially greater than the end face diameter of the spool valve 242 to which they are attached. The diameter of the end face area of the spool valve must be limited since the shear area, or land area, for the spool valve is also related to its diameter. Thus, separate boost pistons are required to be coupled to the second stage spool valve.

Damping tanks 296, 298 are coupled with the chambers 270, 272 and perform a similar function to the damping tanks 96, 98 of the FIG. 1 embodiment. The damping tanks 296, 298 are in communication with the respective chambers 270, 272 through clearances 300, 302 between rods 278, 279 extending from the piston faces 264, 266, and bearings 276, 278 provided at opposite ends of the spool valve housing walls 338. The clearances 300, 302 provide the function of laminar restrictors for communication between the chamber volumes 270, 272 and the damping tanks 296, 298.

Stabilizing springs 286, 288 are provided in the damping tanks 296, 298. The stabilizing springs 286, 288 extend from the walls 338, which are fixed, to plates 282, 284 that are adjustably affixed to the piston rods 274, 276. The stabilizing springs 286, 288 provide opposite biasing forces on the spool valve 242.

First 248 and second 250 second-stage output channels are provided extending from the second-stage spool valve 242 to the output motor 304. The output motor 304 has helical motor gears 305 to provide a rotary output. One of the motor gears 305 is connected to a planocentric gear train 306 to provide gear reduction. The output shaft 308 of the gear train 306 includes a worm 307. A gear 309 meshes with the worm 307 to provide angular displacement of a feedback shaft 311.

As in the FIG. 1 embodiment, both electrical and mechanical feedback arrangements are provided. Mechanical feedback is provided by two feedback arrangements, a first feedback arrangement 312 from the second-stage servo valve 240 to the first-stage servo valve 210, and a second feedback arrangement 320 from the output of the feedback shaft 311 to the first-stage servo valve 210.

The first feedback arrangement 312 comprises a bell crank lever 314, one end 315 in contact with the piston 262 of the second-stage spool valve 242, and the other end 316 coupled to the first-stage vane valve 212 through an abutment 313 and a first feedback spring 318. End 315 of the bell crank 314 may be fixed to the piston 262. A second spring 336 is disposed adjacent the vane valve 212 to bias the vane valve 212 in a direction opposite to the first feedback spring 318. The second spring 336 is coupled to a spring adjustment mechanism 317 associated with a fixed reference, such as an assembly housing.

The first feedback arrangement 312 operates in a manner similar to the first feedback arrangement 112 of the FIG. 1 embodiment. When the first-stage vane valve 212 is moved to its second position (counterclockwise), such that the annular ring 216 of the valve 212 is shifted downwardly in FIG. 2. The annular ring 216 on vane valve 212 uncovers output opening 219 as best shown in FIG. 3 to allow chamber 272 to vent to the surrounding environment through passage 224. At the same time, air under pressure from the fluid source 229 is directed from the center 231 of the annular ring 216 through output opening 217 to the first output conduit 222. The fluid under pressure in conduit 222 enters chamber 270. Since chamber 272 is vented to the surrounding environment a pressure differential is created across spool valve 242. This pressure differential acts on boost piston 260 to move the second-stage spool valve 242 toward the left side of FIG. 2. Movement of the spool valve 242 toward the left serves to lengthen the first feedback spring 318 which serves to re-center, or substantially re-center, the first-stage vane valve 212 in its first position.

The second feedback arrangement comprises a second feeback arm 321 coupled to feedback shaft 311 for angular movement thereby. End 323 of the feedback arm 321 is connected with linkage 208 through a feedback spring 360 to move the first-stage vane valve 212 in a direction to cause the second-stage spool valve to move back toward its first position. For example, if an inputs signal to the torque motor 202 results in movement of the first-stage vane valve 212 to its second position (counterclockwise), the second-stage spool valve 242 will be moved to its second position (leftward movement), thus causing the vane valve 212 to move back toward its first position by the first feedback arrangement 312. Clockwise displacement of the feedback arm 321 will then cause the end 323 to compress the spring 360 thus urging the linkage 208 towards the left, causing the vane valve 212 to move from its first position to its third position (clockwise) to thus move the spool valve 242 back toward its first position (rightward). This re-centering of the second-stage spool valve 242 to its first position results in feedback movement of the bell crank 315 from the second-stage spool valve to the first stage to compress the first feedback spring 318 thus tending to re-center the first-stage vane valve 212 to its first position. The system is now ready for another operation.

As in the FIG. 1 embodiment, electrical feedback can also be provided, Electrical feedback is provided by a feedback resolver 310 which provides an electrical signal through the terminal plug 207 back to a control apparatus 205 which then processes the feedback signal to provide an input signal to the torque motor 202 to thus position the first-stage vane valve as requested.

Above, specific embodiments of the present invention have been described. It should be appreciated, however, that these embodiments were described for purposes of illustration only, without any intention of limiting the scope of the present invention. Rather, it is the intention of the present invention to be limited not by the above, but only as is defined in the appended claims.

I claim:

1. A two-stage pneumatic servo valve assembly for controlling a pneumatic powered output motor comprising:

a pneumatic powered output motor capable of providing a mechanical output in opposite directions;

a two-stage servo valve means for coupling a pneumatic fluid source to said output motor to drive said output motor in opposite directions;

an input means coupled to said two-stage servo valve means for converting an input signal to a mechanical output signal and for controlling said two-stage servo valve means to drive said output motor in opposite directions;

wherein said two-stage servo valve means comprises;

a first-stage valve means for controlling fluid flow from said pneumatic fluid source to a second-stage valve means, said first-stage valve means comprising a first-stage input channel for receiving pneumatic fluid from said pneumatic fluid source, first and second first-stage output channels for supplying pneumatic fluid from said first-stage input channel to said second-stage valve means, and a vane valve coupled to said input means for movement thereby, said vane valve having an annular ring on an end thereof, said first stage input channel being connected to the center of said annular ring, said vane valve being pivoted by said input means to move said annular ring between a first position, wherein fluid communication between said first-stage input channel is restricted from flowing from the center to both the first and second first-stage output channels, a second position, wherein a fluid communication path is open between said center and a first arcuate port of said first first-stage output channel while a second arcuate port for said second first-stage output channel is communicated to the surrounding environment, and a third position, wherein a fluid communication path is open between said center of the arcuate ring and the second arcuate portion of said second first-stage output channel while said first arcuate port of said first first-stage output channel is communicated to the surrounding environment, said mechanical output signal of said input means being coupled to said first-stage valve to move said vane valve from its first position to one of said second and third positions;

said second-stage valve means for controlling fluid flow from said pneumatic fluid source to said output motor, said second-stage valve means comprising a second-stage input channel for receiving pneumatic fluid from said pneumatic fluid source, first and second-stage output channels for supplying pneumatic fluid from said second-stage input channel to said output motor;

first and second pistons operatively connected with said first and second first-stage output channels, said first and second pistons being movable between a first position wherein fluid communication between said second-stage input channel is restricted to both the first and second second-stage output channels, a second position, wherein a fluid communication path is open between said second-stage input channel and said first second-stage output channel only, and a third position, wherein a fluid communication path is open between said second-stage input channel and said second second-stage output channel only, wherein pneumatic fluid flow from said first and second first-stage output channels moves said second-stage valve between its first, second, and third positions;

spring means connected to said first and second pistons for preventing transient movements thereof caused by changes in the fluid pressure of said pneumatic fluid source, and adjustment means connected to said spring means for centering said first and second pistons between said first and second second-stage output channels to establish said first position;

first feedback means for moving said first-stage valve toward its first position in response to movement of said second-stage valve; and second feedback means for controlling said first-stage valve to move said second-stage valve towrd its first position in response to said output motor mechanical output.

2. A two-stage pneumatic servo valve assembly as claimed in claim 1 further comprising a variable pneumatic fluid supply source in fluid communication with said first-stage and second-stage input channels.

3. A two-stage pneumatic servo valve assembly as claimed in claim 2 wherein said variable pneumatic fluid supply source varies over a wide range.

4. A two-stage servo valve assembly as claimed in claim 1 wherein said spring means comprises a first spring and a second spring, said first and second springs coupled to said first and second pistons, each of said first and second springs biasing said second-stage valve in opposite directions.

5. A two-stage pneumatic servo valve assembly as claimed in claim 1 wherein said pneumatic powered output motor comprises a pneumatic gear motor, and wherein said gear motor is coupled to a gear reduction means for providing a mechanical output.

6. A two-stage pneumatic servo valve assembly as claimed in claim 1 wherein said second feedback means comprises a feedback arm coupled between the mechanical output of said output motor and said first-stage valve and movable by the mechanical output of said output motor for urging said first-stage valve from one of its said second and third positions toward its first position.

7. A two-stage pneumatic servo valve as claimed in claim 1 wherein said second feedback means comprises an electrical feedback means for converting the mechanical output of said output motor to an electrical feedback signal, and means for coupling the electrical feedback signal with said input means for moving said first-stage valve.

* * * * *